US006684591B2

(12) United States Patent
Jean

(10) Patent No.: US 6,684,591 B2
(45) Date of Patent: Feb. 3, 2004

(54) CARD LIKE CONSTRUCTION ELEMENT

(76) Inventor: Richard Jean, 137 Jean Poirier, Boucherville, Quebec (CA), J4B 5X8

( * ) Notice: Subject to any disclaimer, the term of this patent is extended or adjusted under 35 U.S.C. 154(b) by 0 days.

(21) Appl. No.: 10/012,175

(22) Filed: Nov. 26, 2001

(65) Prior Publication Data

US 2002/0078653 A1 Jun. 27, 2002

(30) Foreign Application Priority Data

Nov. 28, 2000 (CA) ..... 2327553
Jul. 17, 2001 (CA) ..... 2353964

(51) Int. Cl.[7] ..... E04B 2/08

(52) U.S. Cl. ..... 52/589.1; 52/590.1; 52/585.1; 52/586; 52/578; 206/745; 206/176; 206/177; 248/459; 220/529; 220/528; 220/552; 273/153; 273/156; 273/157; 273/276; 273/293; 273/294

(58) Field of Search ..... 206/745, 176, 206/177; 248/459; 220/529, 528, 552; 52/108, 585.1, 586, 578, 589.1, 590.1; 273/153, 156, 157, 276, 293, 294

(56) References Cited

U.S. PATENT DOCUMENTS 1,193,975 A * 8/1916 Beardsley ..... 446/109
1,890,269 A * 12/1932 Swanson ..... 446/102
3,368,316 A * 2/1968 Crowder ..... 446/106
3,666,607 A * 5/1972 Weissman ..... 229/108
3,701,214 A * 10/1972 Sakamoto ..... 273/157 R
3,894,354 A * 7/1975 Crawley ..... 446/124
4,429,486 A * 2/1984 Bjornstad ..... 229/192
4,454,678 A * 6/1984 Duvivier ..... 446/112
4,608,799 A * 9/1986 Hasegawa ..... 446/112
4,852,796 A * 8/1989 Katzman ..... 229/120.32
4,930,681 A * 6/1990 Fultz et al. ..... 229/114
4,976,652 A * 12/1990 Schwartz ..... 273/157 R
5,125,867 A * 6/1992 Solomon ..... 446/109
5,150,789 A * 9/1992 Bass ..... 206/396
5,251,900 A * 10/1993 Gallant ..... 273/157 R
5,281,185 A * 1/1994 Lee ..... 446/109
5,368,225 A * 11/1994 Ritter ..... 229/110
5,662,508 A * 9/1997 Smith ..... 229/127
5,704,542 A * 1/1998 Harrelson ..... 206/140
5,895,045 A * 4/1999 Vilar ..... 273/160
6,086,067 A * 7/2000 Benoit et al. ..... 273/157 R

* cited by examiner

*Primary Examiner*—Carl D. Friedman
*Assistant Examiner*—Christy M. Green
(74) *Attorney, Agent, or Firm*—Eric Fincham

(57) ABSTRACT

A construction element having a card like structure and which can be used to build three dimensional structures, the construction element having upper and lower marginal edges, side marginal edges, first and second upper tabs, first and second lower tabs, and a upper recess formed in an upper marginal edge and a lower recess formed in a lower marginal edge, the lower recesses being designed to receive the lower tabs and upper recesses being designed to receive the upper tabs.

13 Claims, 20 Drawing Sheets

CARD LIKE CONSTRUCTION ELEMENT

FIELD OF THE INVENTION

The present invention relates to a construction element which can be used to construct three dimensional objects.

BACKGROUND OF THE INVENTION

The building of various structures by children has been a common practice for many years. There exist many known construction sets which consist of various types and configurations of interlocking components. Since the advent of plastics, the relatively inexpensive production of these components has permitted a number of different designs to be fabricated. Even previous to such plastic construction elements, pieces of metal with mechanical connectors were used to build different types of structures.

SUMMARY OF THE INVENTION

It is an object of the present invention to provide a new design for a construction element which may be used in constructing three dimensional objects.

It is a further object of the present invention to provide an inexpensive set of construction elements which may carry various graphic images for the amusement of the child.

According to one aspect of the present invention, there is provided a construction element for use in constructing three dimensional objects, the construction element comprising a generally planar main body, the main body having an upper marginal edge, a lower marginal edge, and first and second side marginal edges, an upper recess formed in the upper marginal edge intermediate the side marginal edges, a lower recess formed in the lower marginal edge intermediate the first and second side marginal edges, a first upper tab formed adjacent the intersection of the upper marginal edge and first side marginal edge, a second upper tab formed adjacent the intersection of the upper marginal edge and the second side marginal edge, a first lower tab formed adjacent the intersection of the lower marginal edge and the first side marginal edge, a second lower tab formed adjacent the intersection of the lower marginal edge and the second side marginal edge, and the first and second upper tabs being sized to fit within upper recesses formed in adjacent construction elements and the first and second lower tabs being sized and arranged to fit within lower recesses formed in adjacent structural construction elements.

According to a further aspect of the present invention, there is provided a structure comprised of a plurality of construction elements, each construction element comprising generally planar main body, the main body having an upper marginal edge, a lower marginal edge, and first and second side marginal edges, an upper recess formed in the upper marginal edge intermediate the side marginal edges, a lower recess formed in the lower marginal edge intermediate the first and second side marginal edges, a first upper tab formed adjacent the intersection of the upper marginal edge and first side marginal edge, a second upper tab formed adjacent the intersection of the upper marginal edge and the second side marginal edge, a first lower tab formed adjacent the intersection of the lower marginal edge and the first side marginal edge, a second lower tab formed adjacent the intersection of the lower marginal edge and the second side marginal edge, and the construction element being arranged such that each of the first and second upper tabs fit within an upper recess of an adjacent construction element and each of the first and second lower tabs fit within a lower recess of an adjacent construction element.

In a greater detail, the construction element of the present invention may be formed of any suitable material such as cardboard, plastic, plasticized cardboard, etc. It suffices to say that the elements must have sufficient rigidity to support and form the structure.

The construction elements are preferably of a like size or dimension although it is within the scope of the invention to use elements of differing sizes. Typically, the construction elements may vary with a typical distance between the side walls being between 10 cm and 25 cm and the distance between the top wall and bottom wall being between 7 cm and 15 cm. It will naturally be understood that any size construction element may be employed with a preferred dimension being approximately 17.5 cm by 12.5 cm.

The arrangement of the notches and recesses may be varied depending upon the type of structure envisaged. The upper recess may come in various configurations with a preferred configuration being one of a triangle wherein the apex of the triangle is formed along the upper marginal edge. Similarly, a preferred configuration for the lower recess is a slot configuration, which slot extends vertically.

In one embodiment, there is only provided a single recess in each of the upper and lower marginal edges and preferably that recess is spaced to be half the distance between the side marginal edges. However, it is also possible to have a plurality of recesses such that different type of structures can be formed.

In many embodiments, the side marginal edges and upper and lower marginal edges will be substantially straight. However, it is also within the scope of this invention to have marginal edges of different outlines.

BRIEF DESCRIPTION OF THE DRAWINGS

Having thus generally described the invention, reference will be made to the accompanying drawings illustrating embodiments thereof, in which.

DESCRIPTION OF THE PREFERRED EMBODIMENTS

Figure 1:
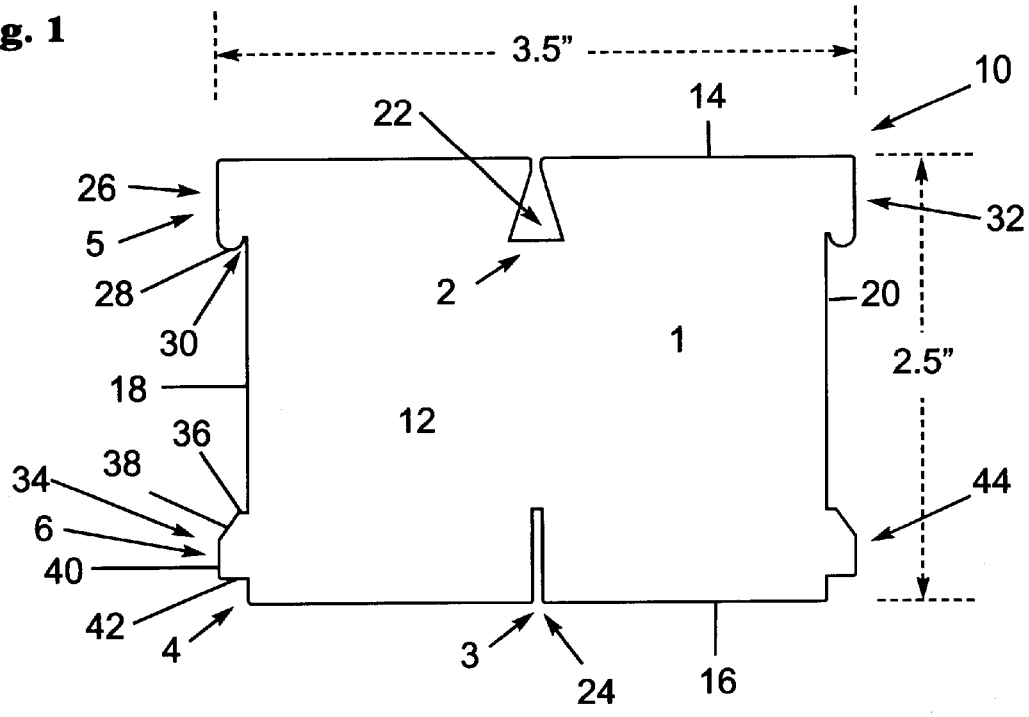
FIG. 1 is a plan view of one embodiment of a construction element according to the present invention.

Referring to the drawings in greater detail and by reference characters thereto, there is illustrated in FIG. 1 a first embodiment of a construction element which is generally designated by reference numeral 10. Construction element 10 has a main body 12 which is of a planar nature having a pair of major opposed faces.

Main body 12 includes an upper marginal edge 14, a lower marginal edge 16, a first side marginal edge 18, and a second side marginal edge 20. For purposes of this description, the terms of upper and lower are used only for ease of description and their usual orientation with respect to a substrate on which the construction element would be placed when used for building a structure.

Formed in upper marginal edge 14 is an upper recess generally designated by reference numeral 22. In the embodiment of FIG. 1, upper recess 22 has a triangular configuration. Formed in lower marginal edge 16 is a lower recess 24 which, in this embodiment, has an elongated slot configuration.

Located proximate the intersection of upper marginal edge 14 and first side marginal edge 18 is a first upper tab generally designated by reference numeral 26. First upper tab 26 has an arcuate edge portion 28 which defines, between first upper tab 26 and first side marginal edge 18, a recess 30. A second upper tab 32 is formed in a similar manner proximate the intersection of upper marginal edge 14 and second side marginal edge 20.

A first lower tab generally designated by reference numeral 34 is located proximate the intersection of lower marginal edge 16 and first side marginal edge 18. First lower tab 34 has a first perpendicular edge section 36 extending outwardly from first side marginal edge 18 at an angle of 90°, a diagonal edge portion 38, a vertical edge portion 40, and a bottom perpendicular edge portion 42. As may be seen in FIG. 1, first lower tab 34 is situated slightly upwardly of lower marginal edge 16. A second lower tab 44 is formed on second side marginal edge 22 proximate its intersection with lower marginal edge 16.

Figure 2:
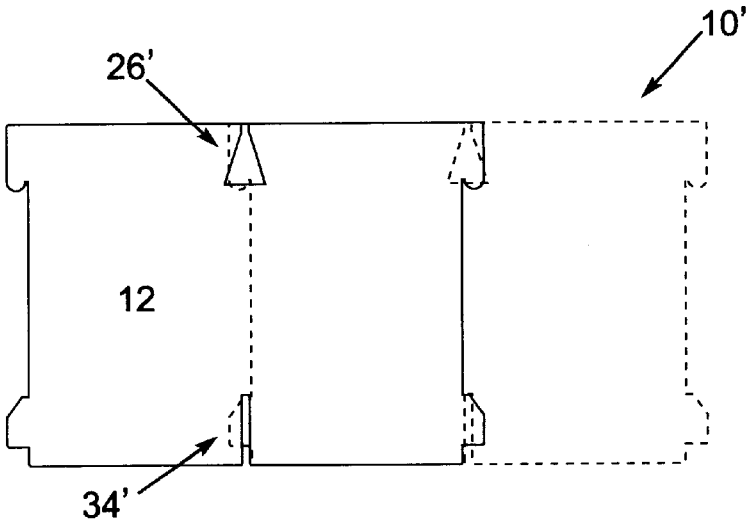
FIG. 2 is a plan view illustrating the major connection of two adjacent construction elements.

As may be seen in FIG. 2, a pair of identical construction elements 10 and 10' may be joined together with first upper tab 26' of construction element 10' fitting within recess 22 of construction element 10. Similarly, first lower tab 34' of construction element 10' fits within recess 24 of construction element 10.

Figure 3:
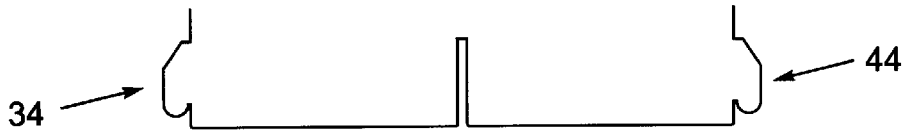
FIG. 3 is a plan view of a modified bottom portion of the construction element of FIG. 1.

In FIG. 3, lower tabs 34, 44 are shown with a profile similar to that of upper tabs 26, 32.

In many of the drawings to be discussed hereinbelow, many of the embodiments to be described have the common features of upper and lower tabs, upper and side marginal edges and upper and lower recesses. Accordingly, a common reference numeral will be used for these common features even though the various configurations thereof may be somewhat different.

Thus, in referring to the drawings, each of the embodiments usually has an upper marginal edge 70, a lower marginal edge 72, and side marginal edges 74 and 76. A pair of upper tabs 78, 80 and lower tabs 82, 84 are respectively designed to fit within an upper recess 86 and a lower recess 88 of an adjacent element.

Figure 4:
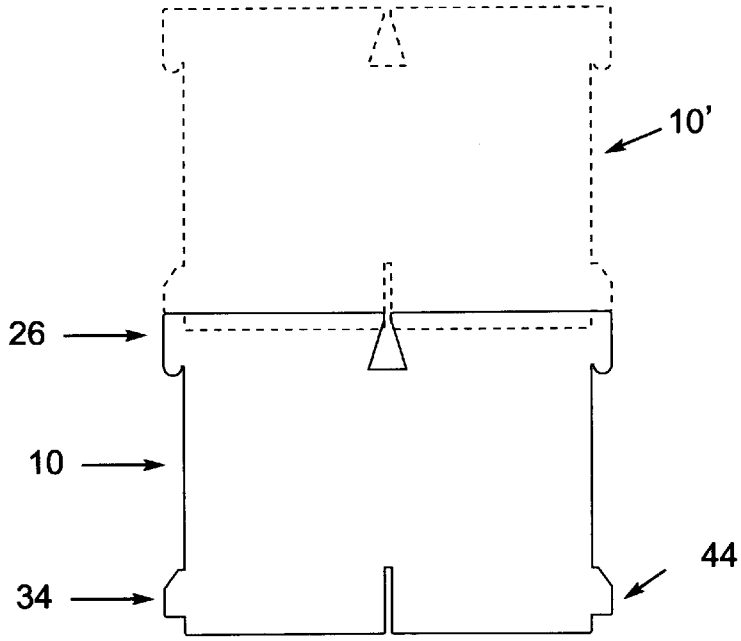
FIG. 4 is a plan view illustrating the placing of one construction element on top of another.
Figure 4:
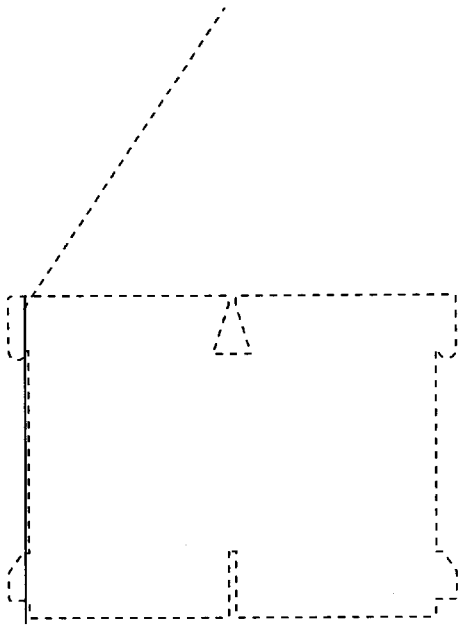

FIG. 4 illustrates an arrangement wherein one construction element may be placed on top of a further one.

Figure 5:
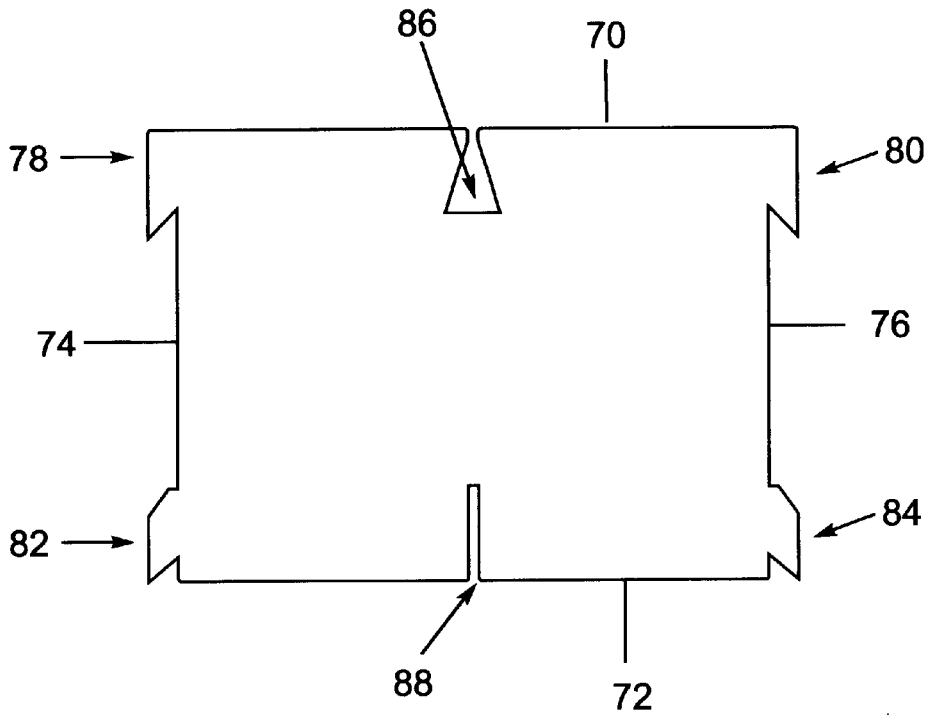
FIGS. 5 to 37 illustrate varying embodiments of the construction element according to the present invention.

In FIG. 5, an embodiment is shown wherein both upper tabs 78, 80 and lower tabs 82, 84 have a angle formed at the lower edges thereof.

Figure 6:
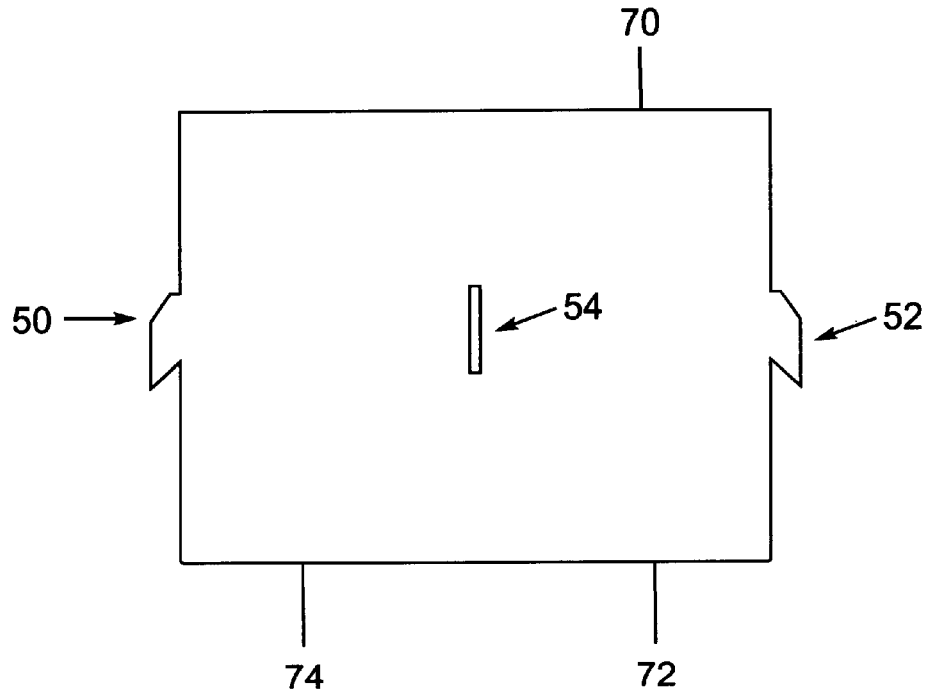

In FIG. 6, a different type of arrangement is shown in that there are provided tabs 50 and 52 which are located intermediate the upper marginal edge 70 and lower marginal edge 72. There is also provided a central recess 54 designed to receive such a tab.

Figure 7:
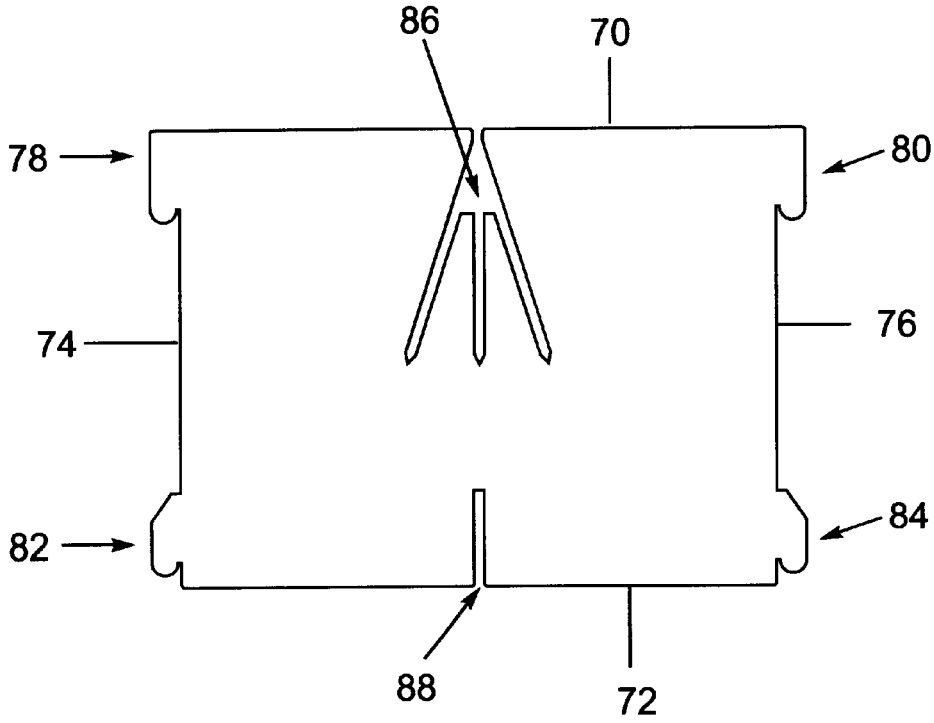
Figure 8:
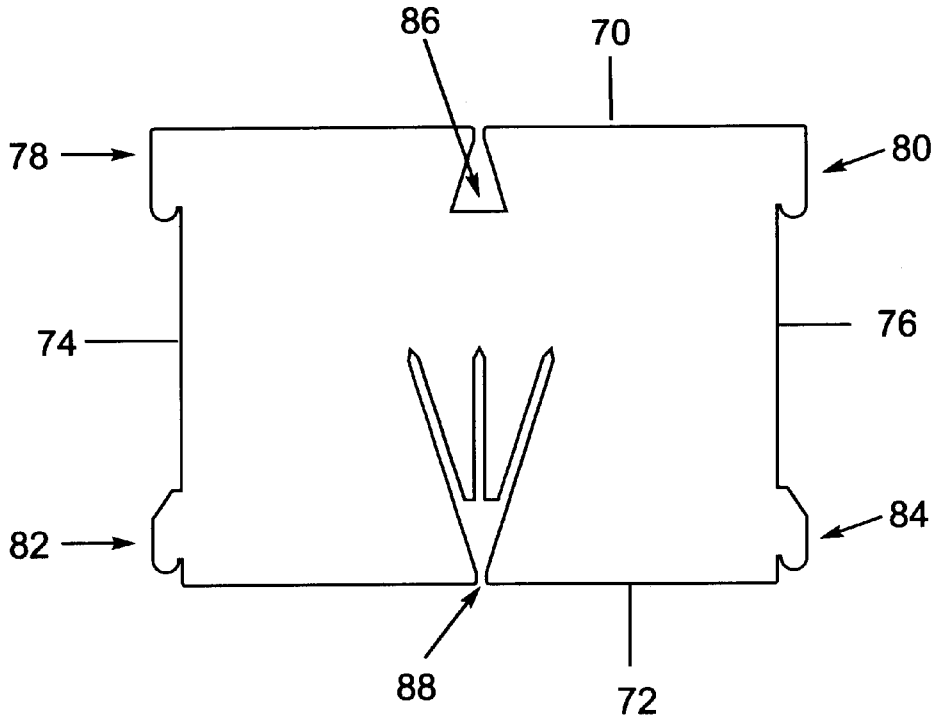

As shown in FIG. 7, upper recess 86 may include a plurality of slots to provide for angular placement of a tab therein. A reverse arrangement is shown in FIG. 8 wherein the plurality of slots in the lower recess is provided.

Figure 9:
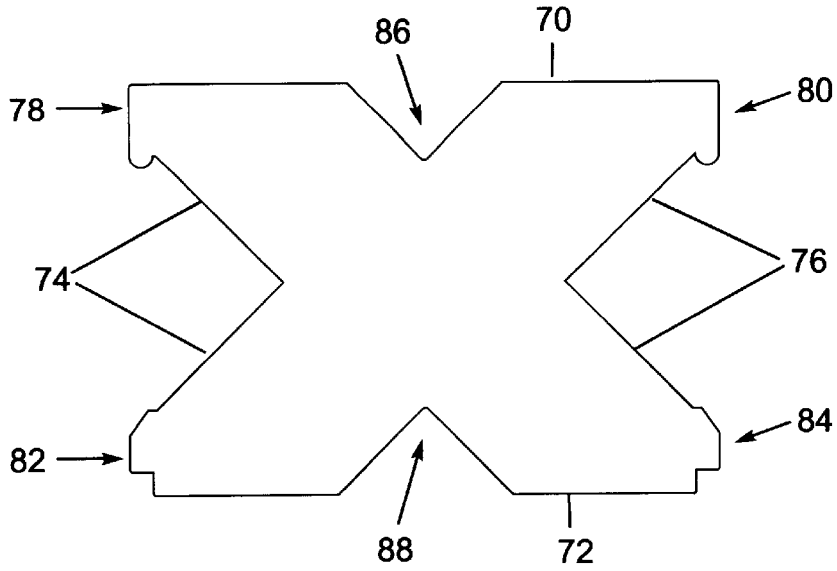

In FIG. 9, both upper recess 86 and lower recess 88 take the form of an indentation in the upper marginal edge 70 and lower marginal edge 72 respectively. It will also be noted that side marginal edges 74 and 76 are likewise indented.

Figure 10:
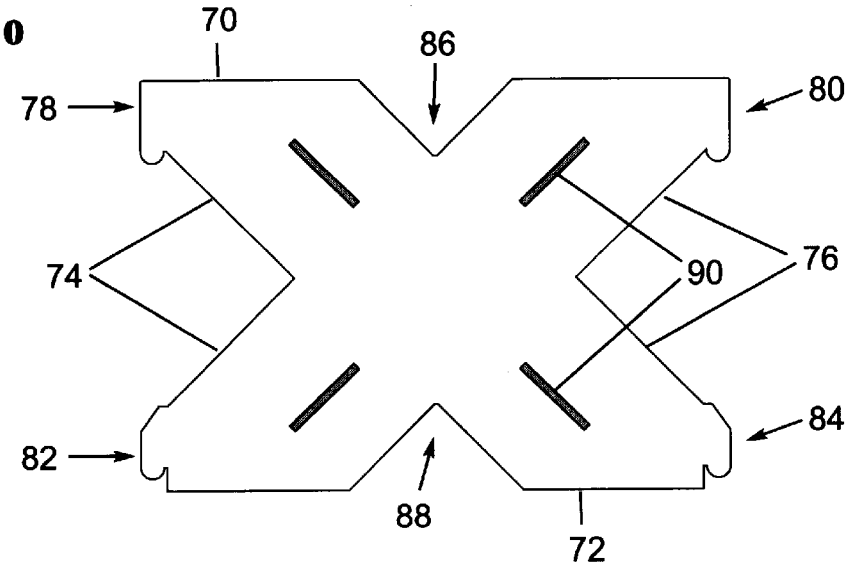
Figure 11:
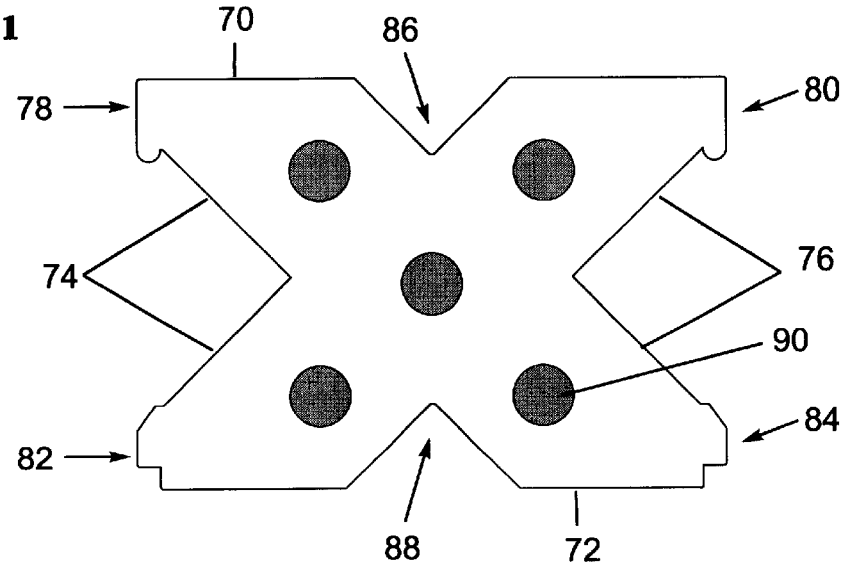

FIG. 10 shows an arrangement similar to FIG. 9 except that a plurality of centrally located recesses are provided. Similarly, in FIG. 11, central recesses 90 assume a different configuration.

Figure 12:
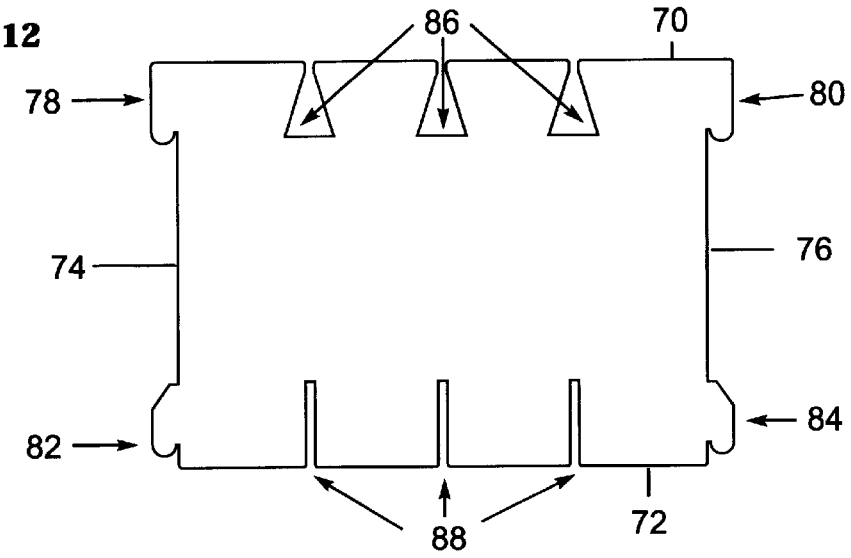

FIG. 12 illustrates a modified arrangement wherein there are provided three upper recesses 86, each equidistantly spaced. Three corresponding lower recesses 88 are also provided in lower marginal edge 72.

Figure 13:
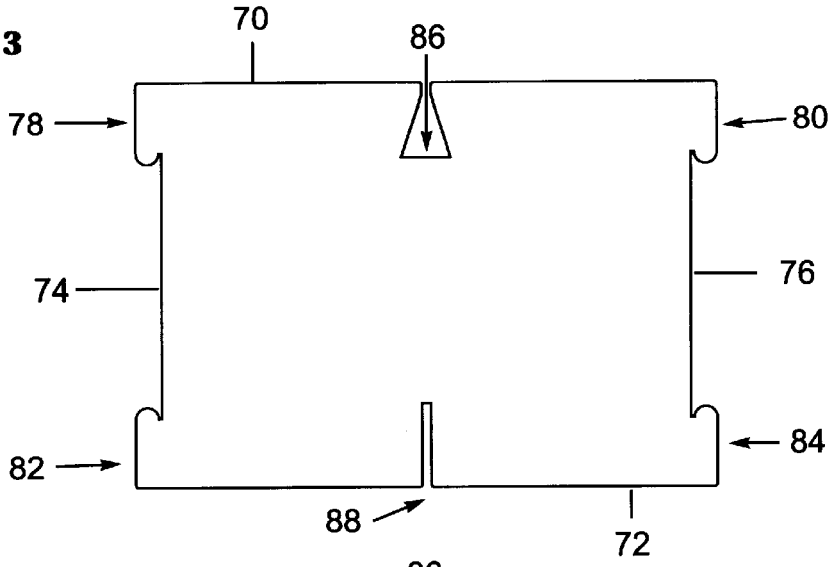

FIG. 13 illustrates an embodiment wherein the lower tabs 82 and 84 have a different upside down configuration.

Figure 14:
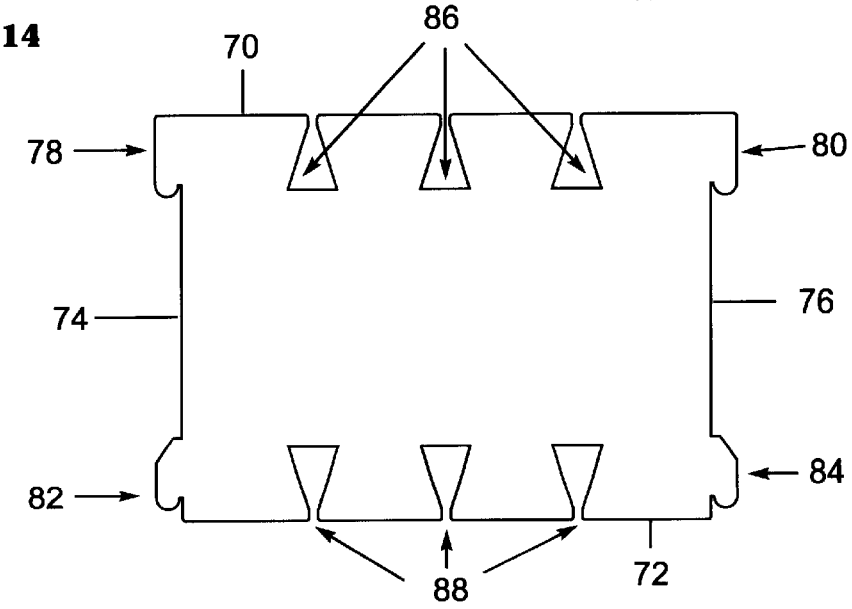

In FIG. 14, in a manner similar to FIG. 12, a plurality of upper recesses 86 and lower recesses 88 are provided, each being in the form of a triangular outline.

Figure 15:
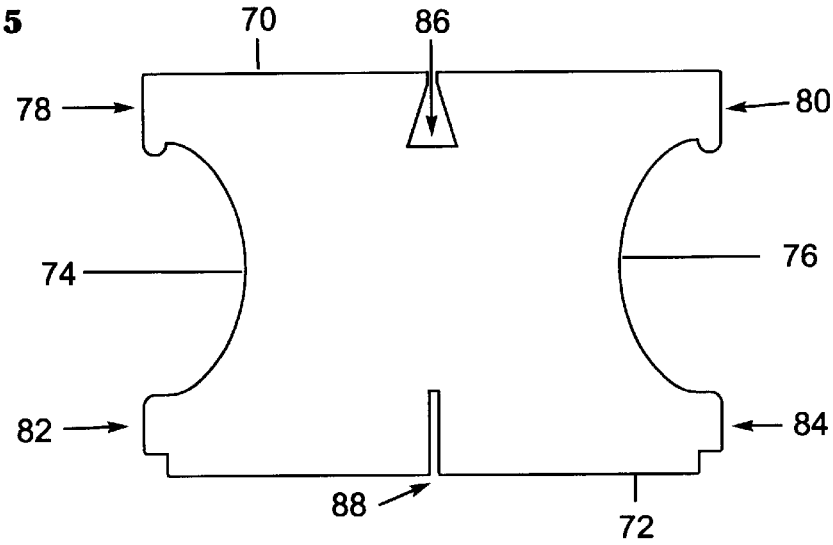
Figure 16:
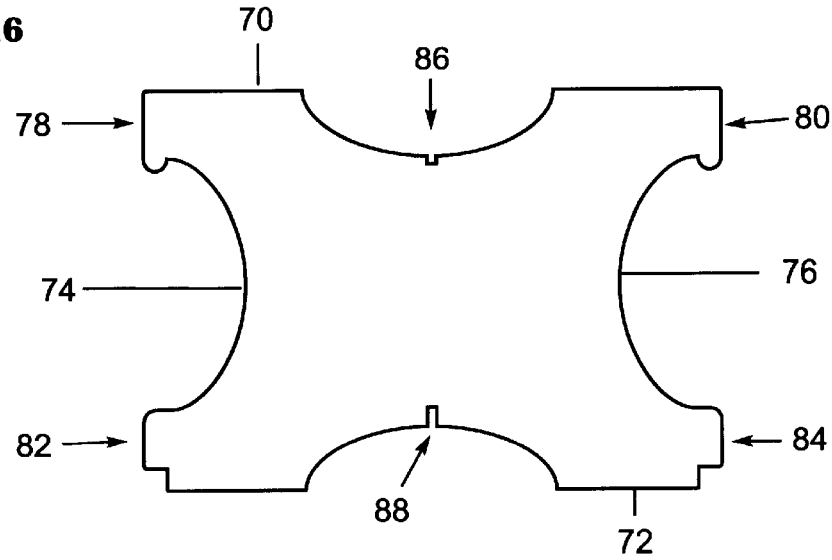
Figure 17:
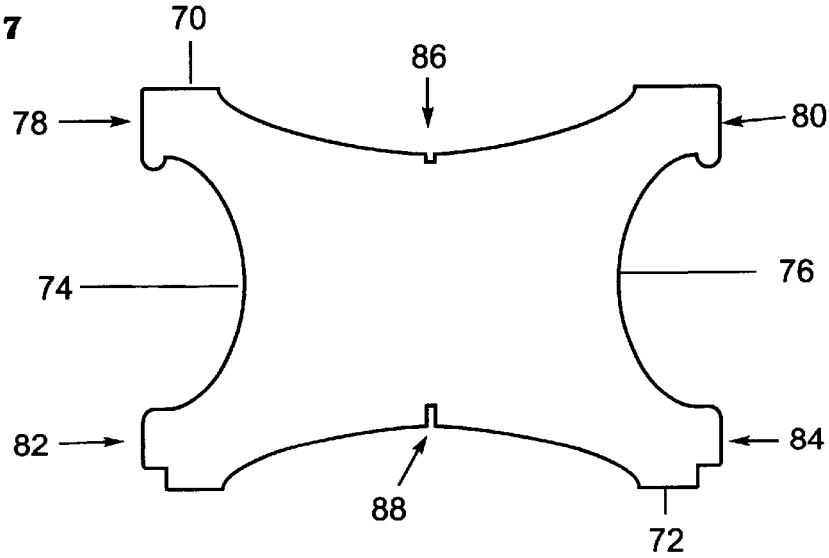

FIGS. 15 to 17 illustrate different embodiments wherein the side marginal edges and both the upper and lower marginal edge may assume different forms as well as the corresponding recesses 86 and 88.

Figure 18:
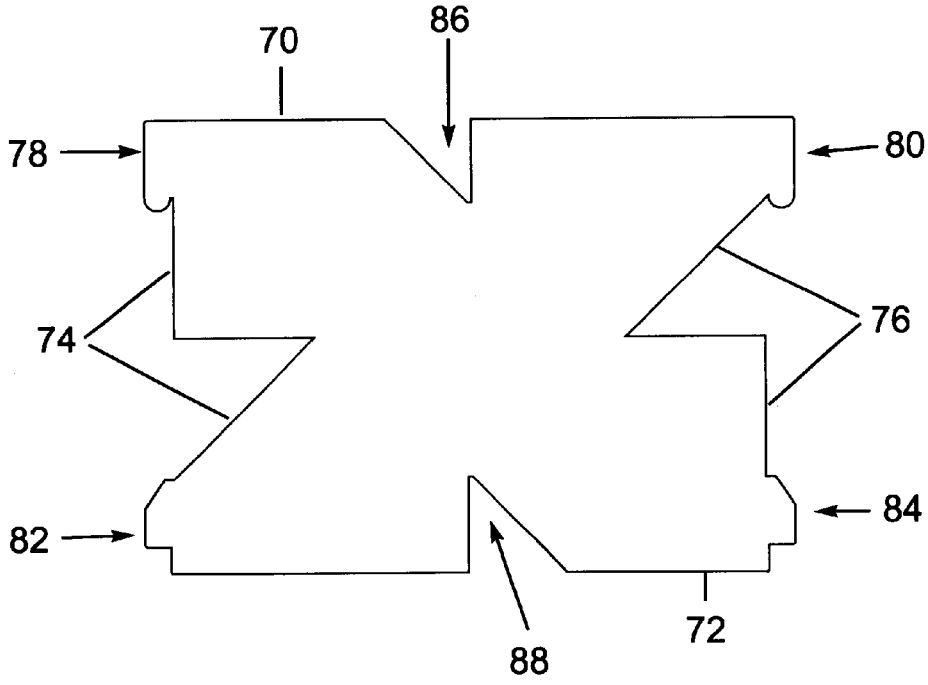
Figure 19:
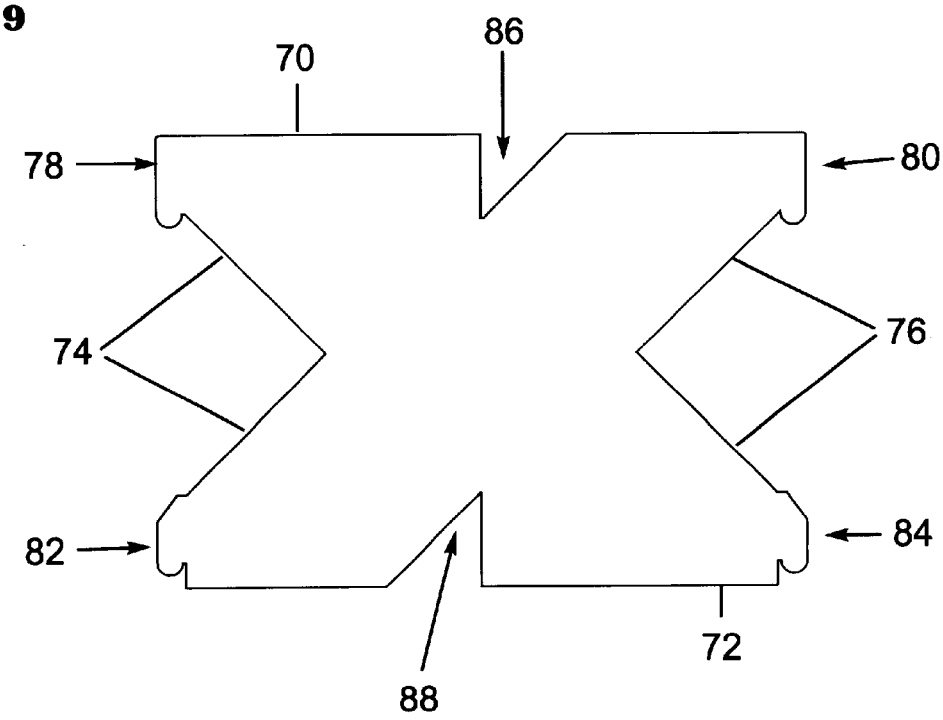

Similarly, FIGS. 18 and 19 illustrate embodiments wherein the upper and lower recesses 86 and 88 have different forms and as well, side marginal edges 74, 76 may be recessed or indented in different configurations.

Figure 20:
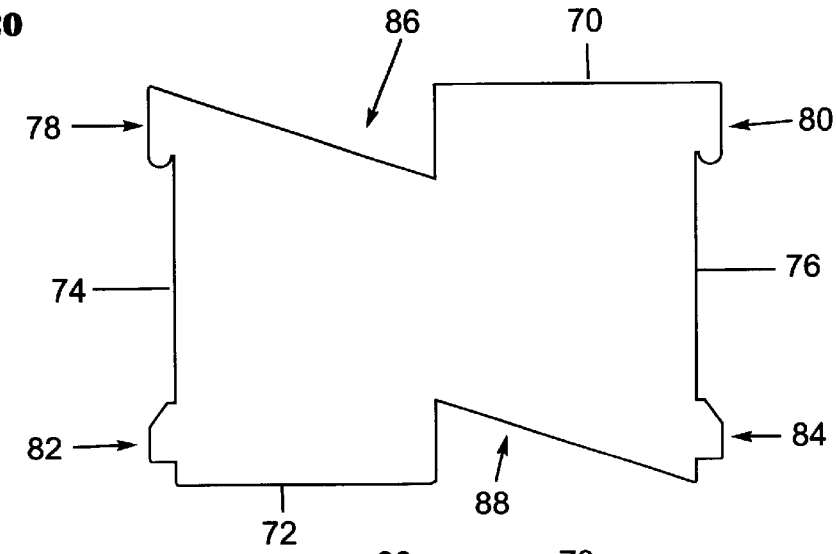
Figure 21:
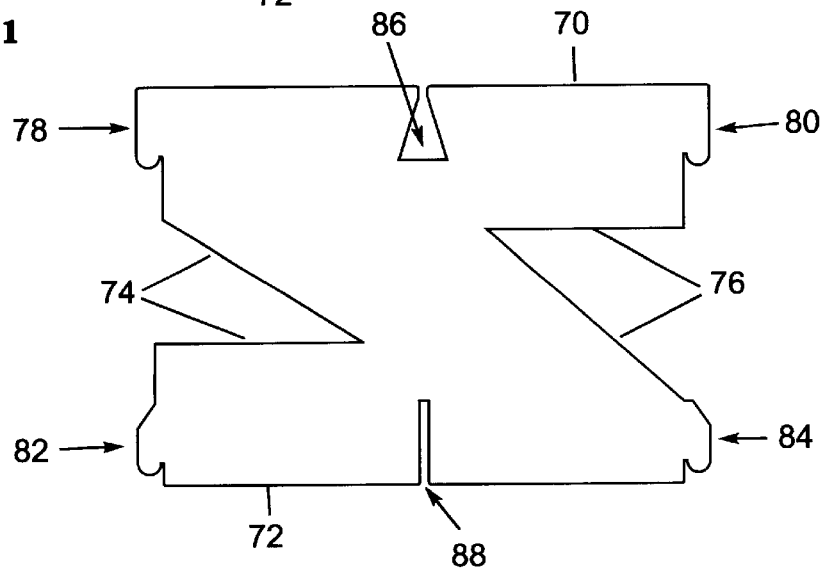
Figure 22:
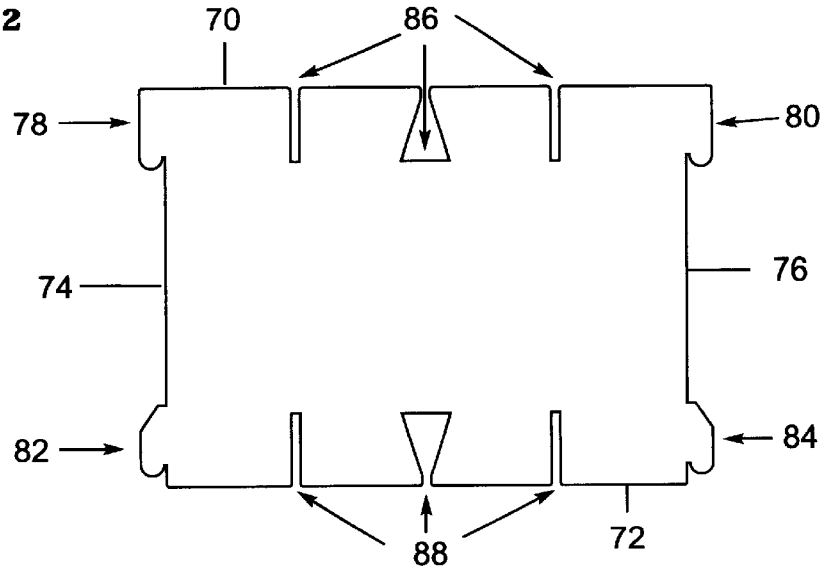
Figure 23:
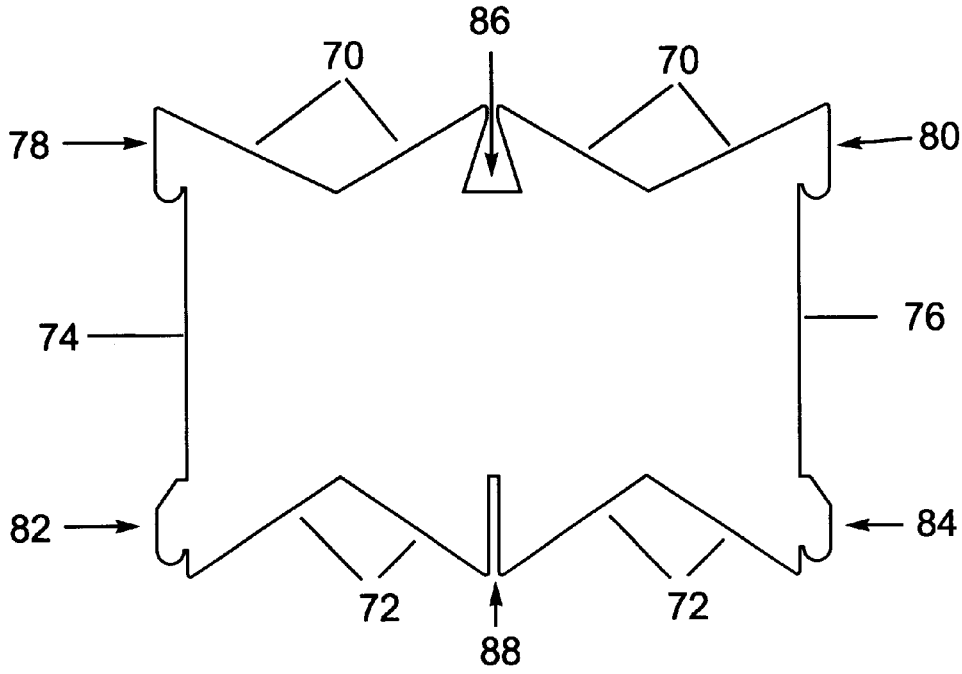
Figure 24:
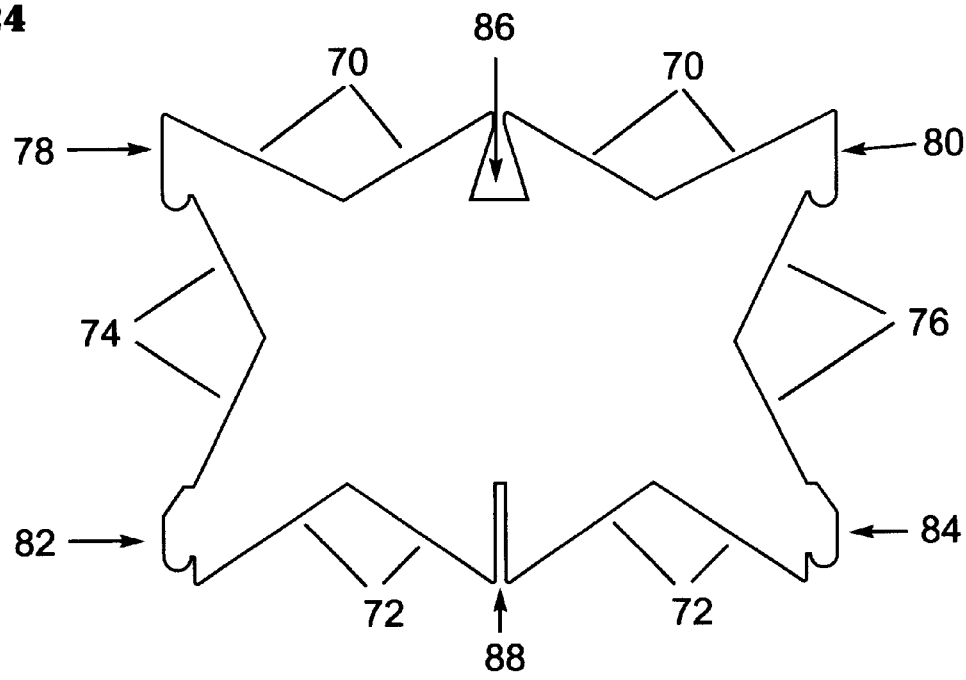
Figure 25:
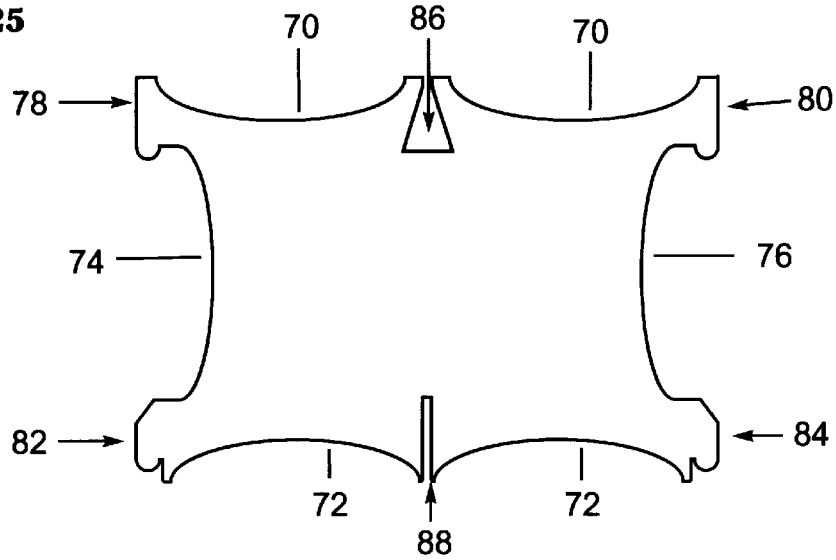
Figure 26:
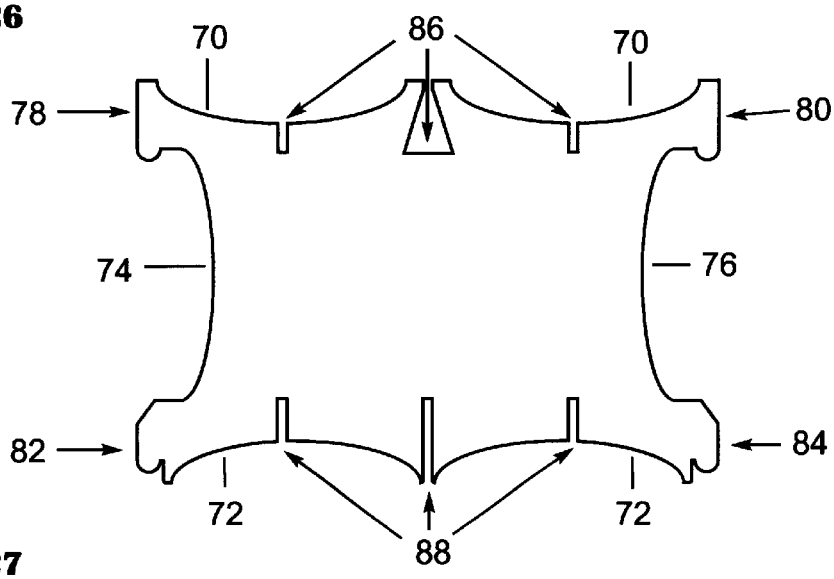
Figure 27:
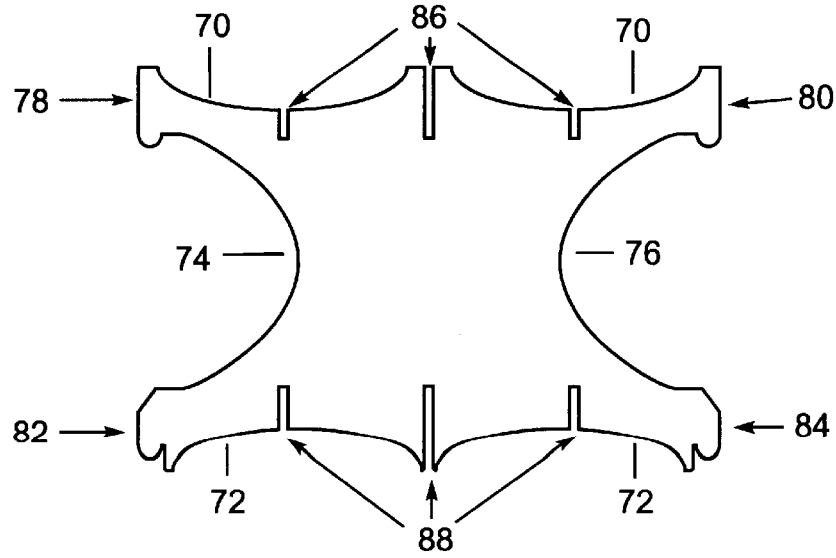

FIGS. 20 and 21 illustrate further possible configurations of the construction element of the present invention while in FIG. 22, there are again shown a plurality of upper and lower recesses 86, 88, with different configurations for the recesses being utilized.

FIGS. 23 to 27 again illustrate various modifications that may be made to the construction element including multiple upper and lower recesses 86, 88 in different configurations along with different outlines for the marginal edges.

Figure 28:
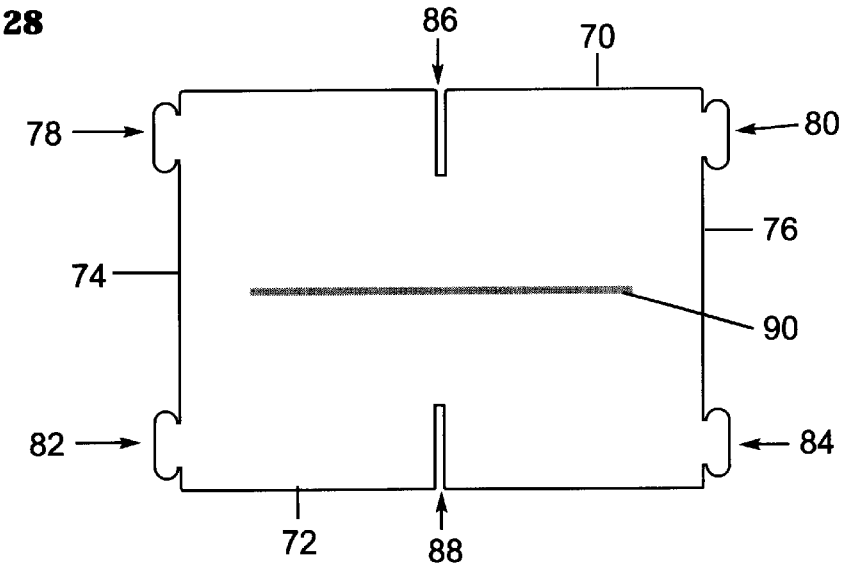
Figure 29:
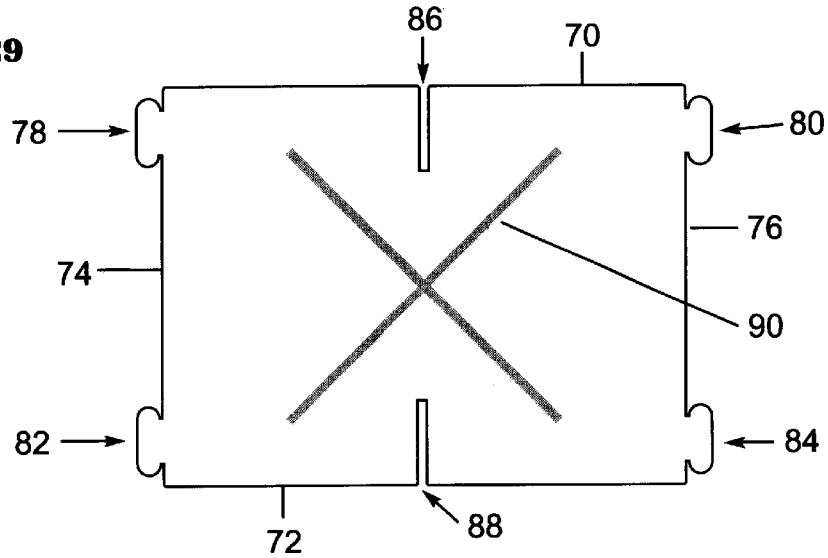
Figure 30:
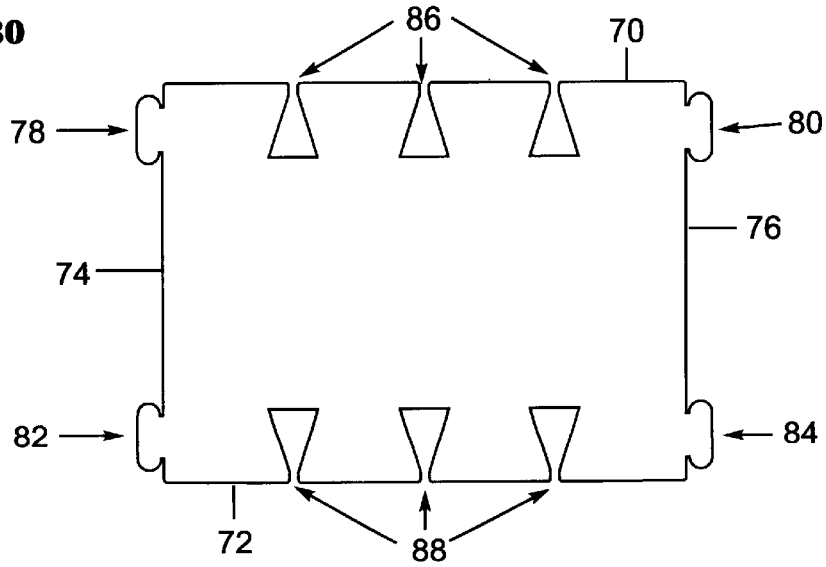

FIGS. 28 and 29 illustrate central apertures 90 of different configurations while FIG. 30 illustrates a still further embodiment using multiple upper and lower recesses 86, 88.

Figure 31:
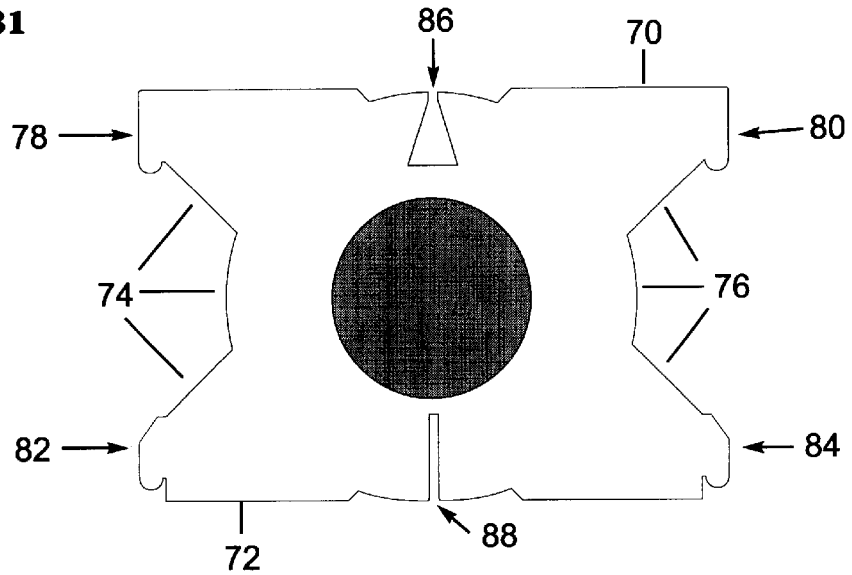
Figure 32:
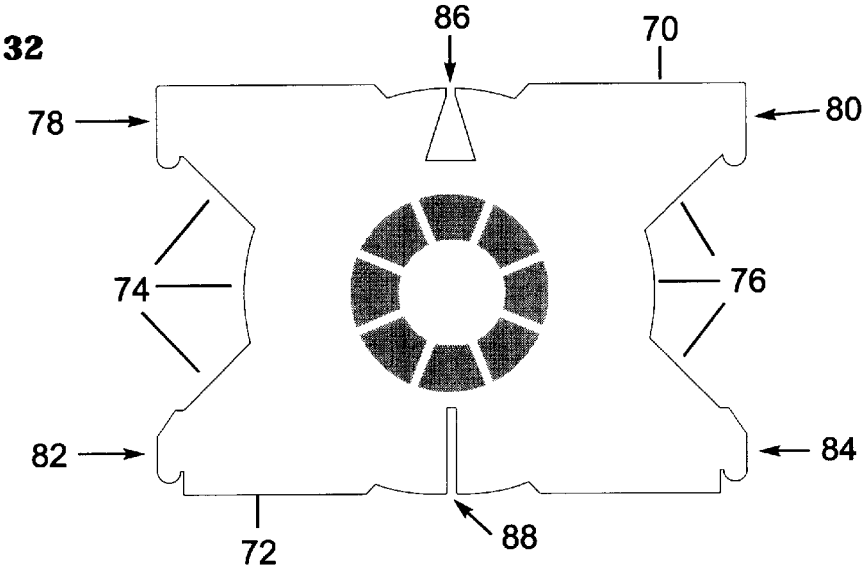
Figure 33:
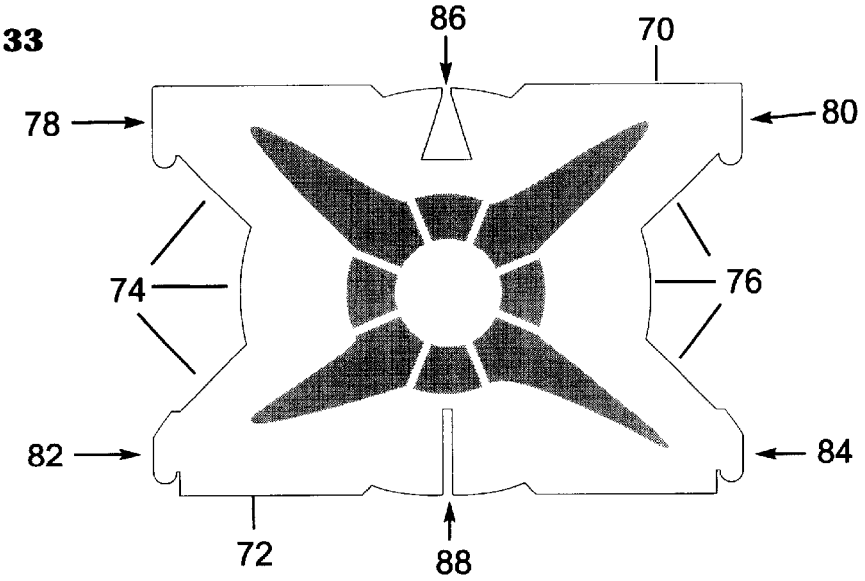

FIGS. 31 to 33 illustrate different configurations of central apertures 90 which may provide decorative effects.

Figure 34:
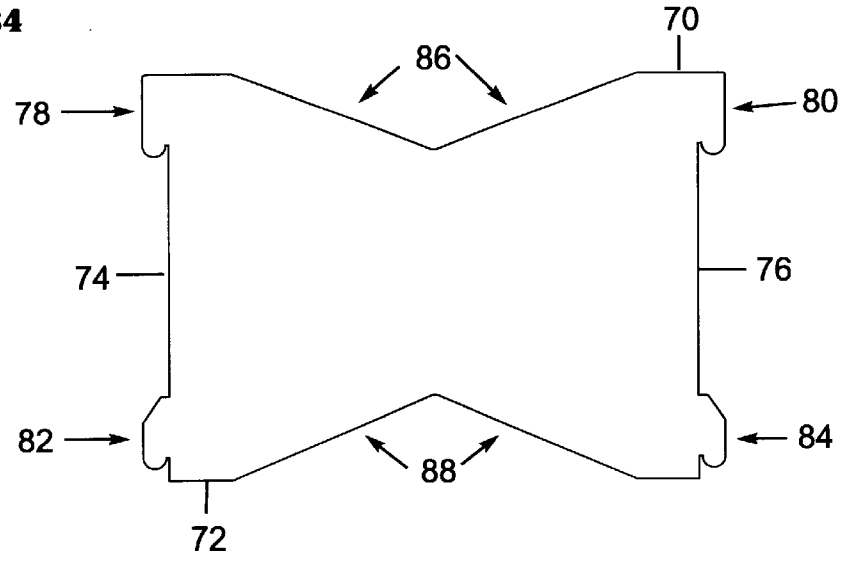
Figure 35:
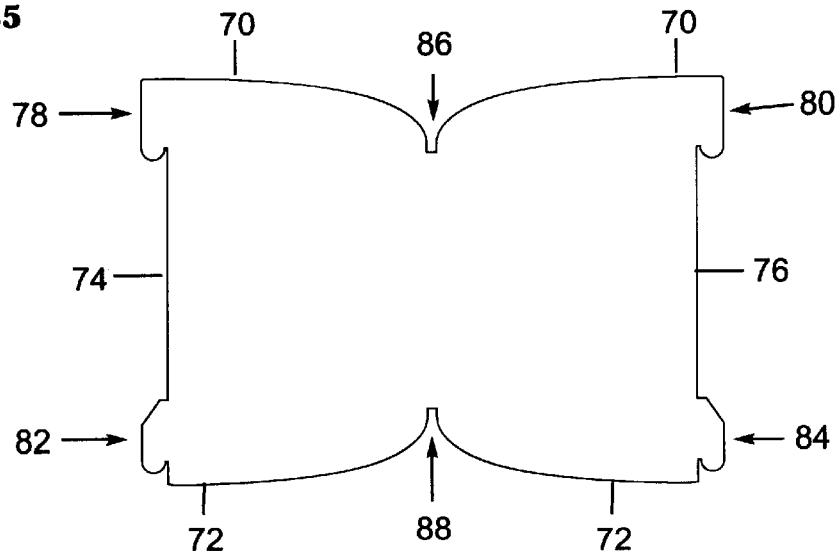
Figure 36:
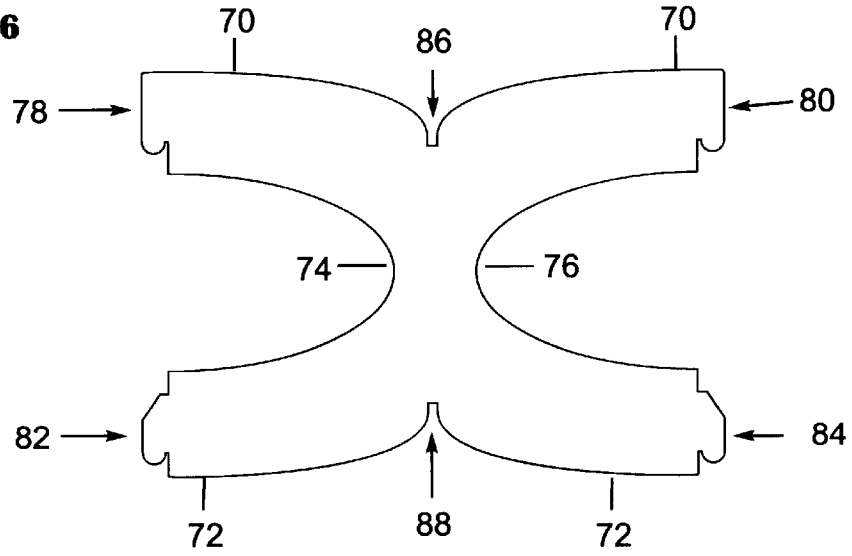
Figure 37:
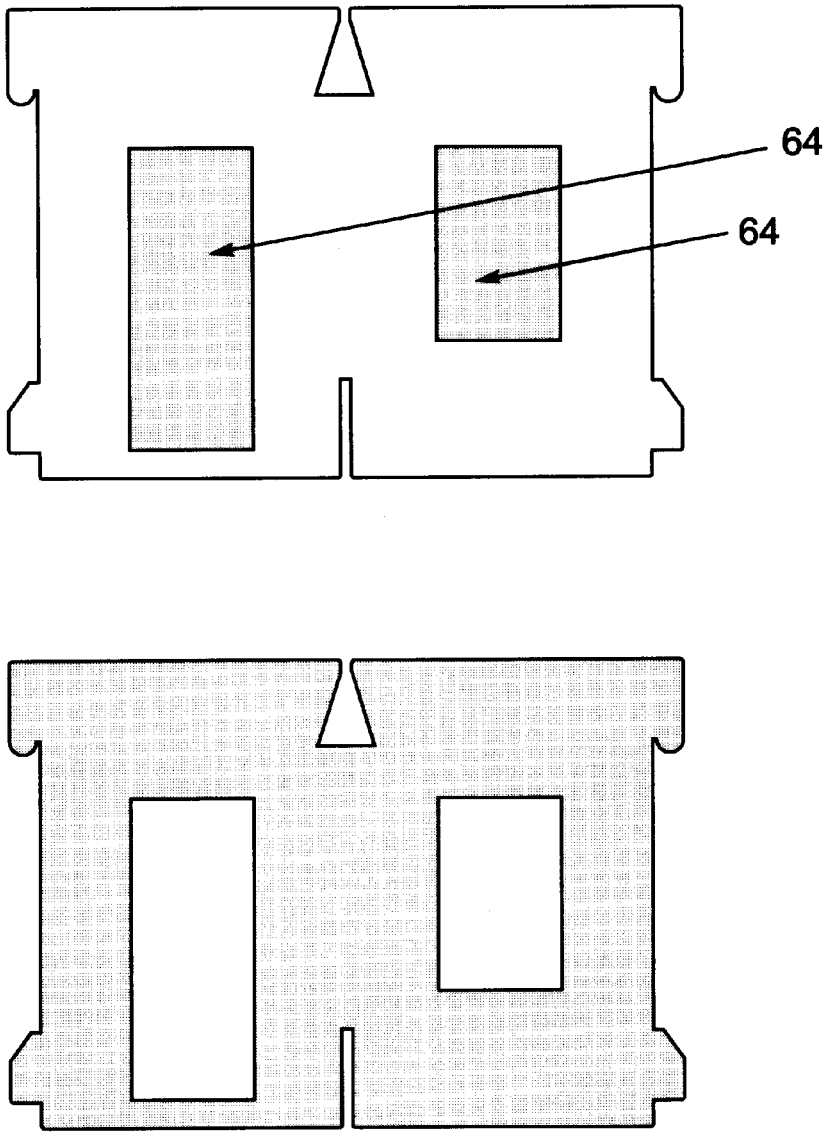

FIGS. 34 to 36 illustrate different configurations of the marginal edges of the construction element while FIG. 37 illustrates that the cutouts 64 may be provided for decorative purposes.

Figure 38:
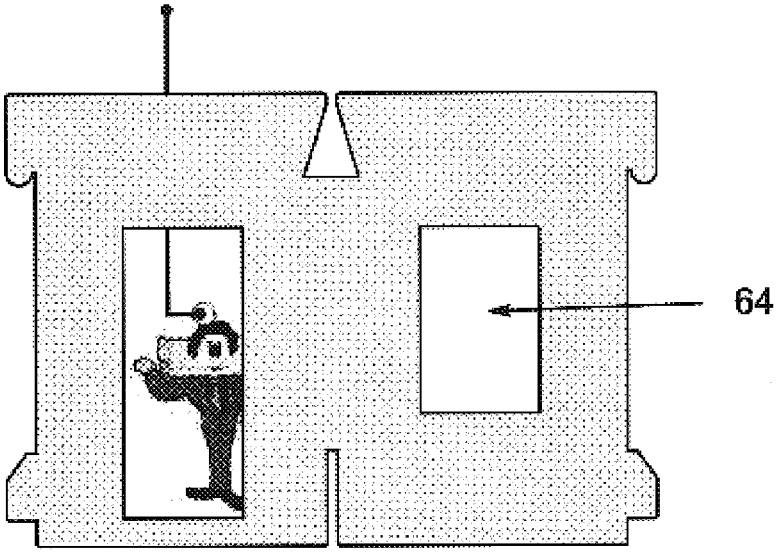
FIG. 38 is a side elevational view showing the use of a cutout character with the construction element of the present invention.
Figure 39:
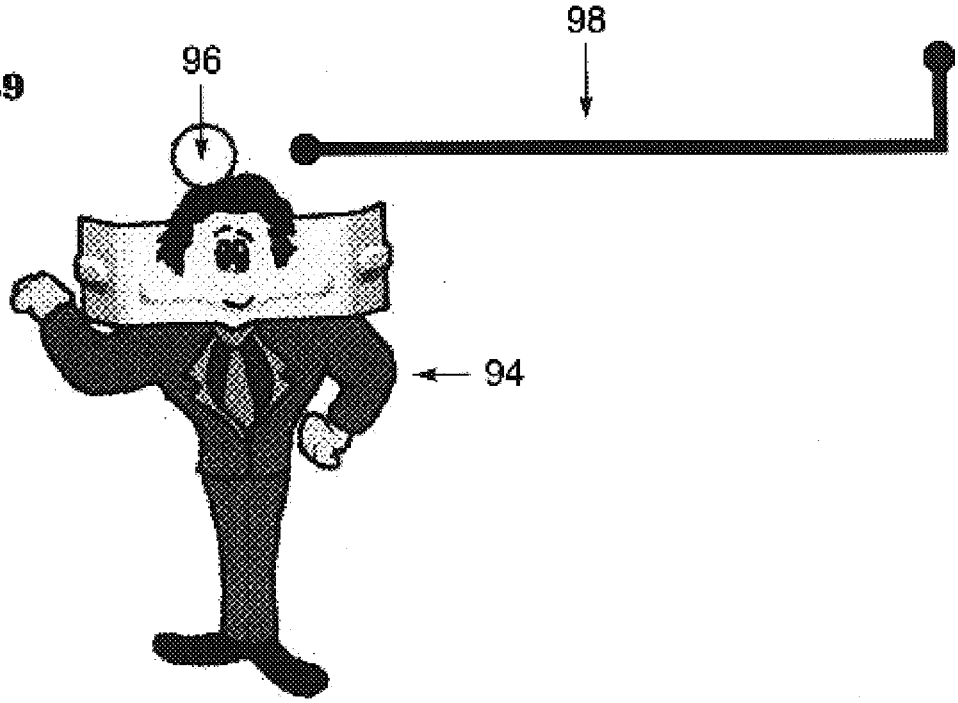
FIG. 39 is an enlarged view of the cutout character showing the placement thereof.
Figure 40:
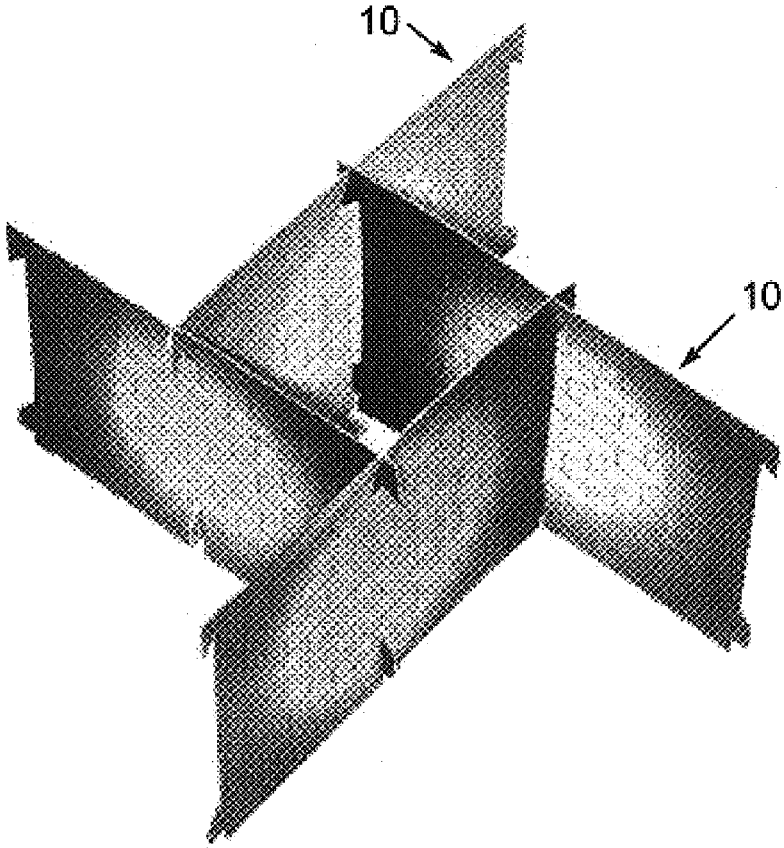
FIGS. 40 to 47 are perspective views of different arrangements of structures which can be built using the construction element of the present invention.
Figure 41:
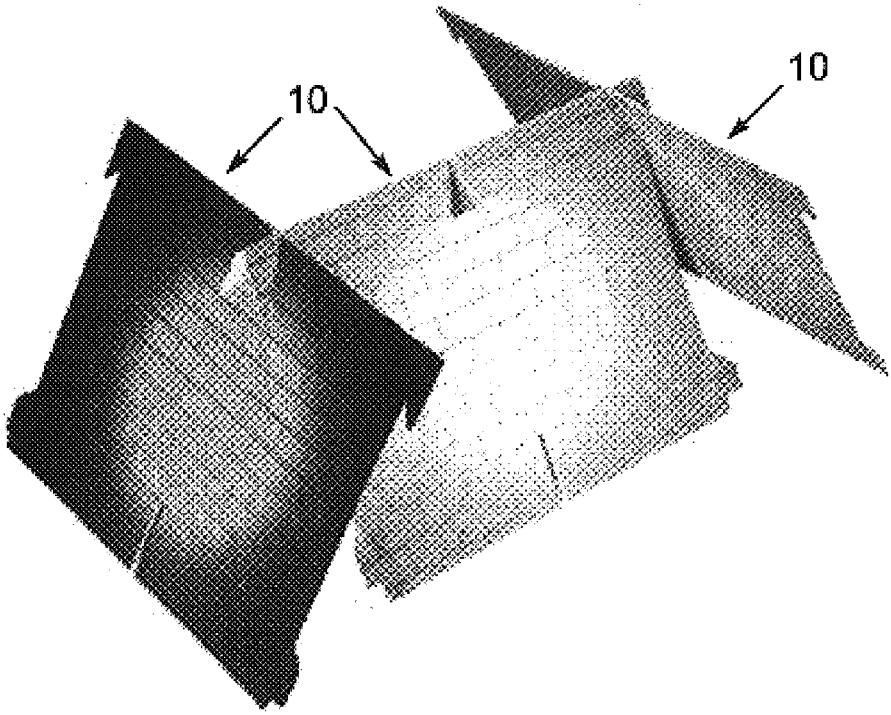
Figure 42:
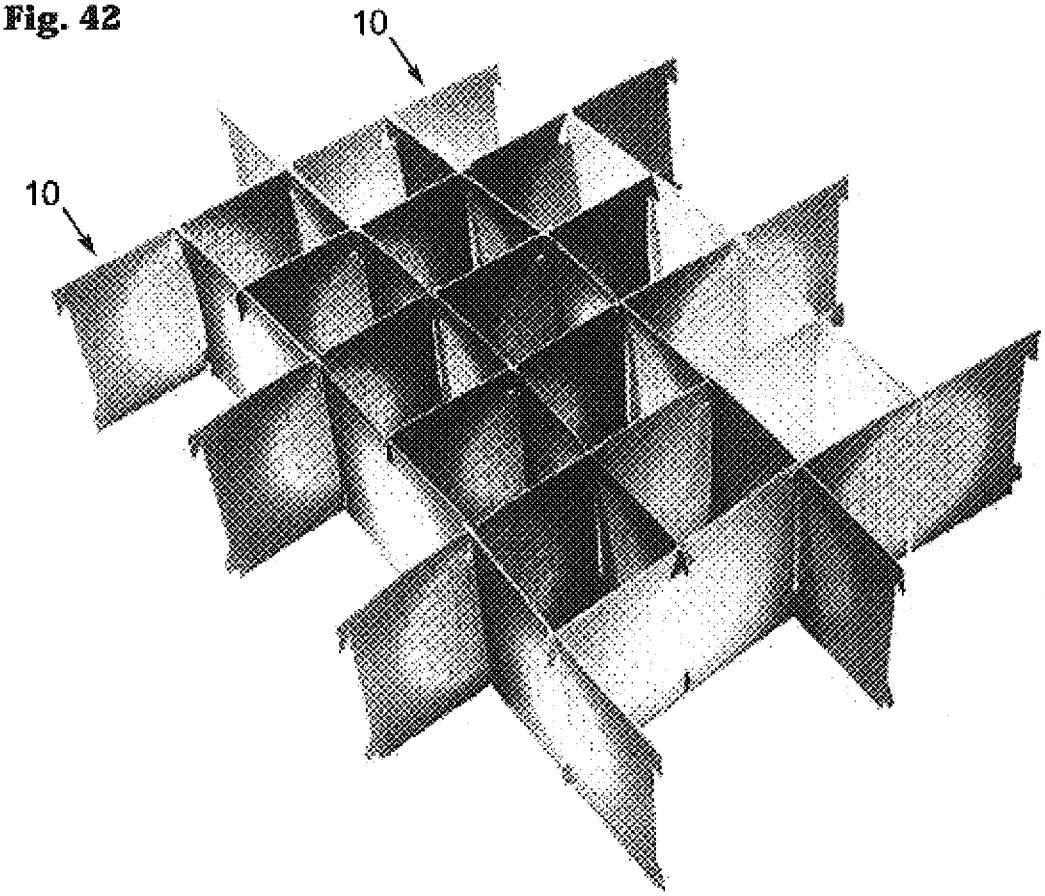
Figure 43:
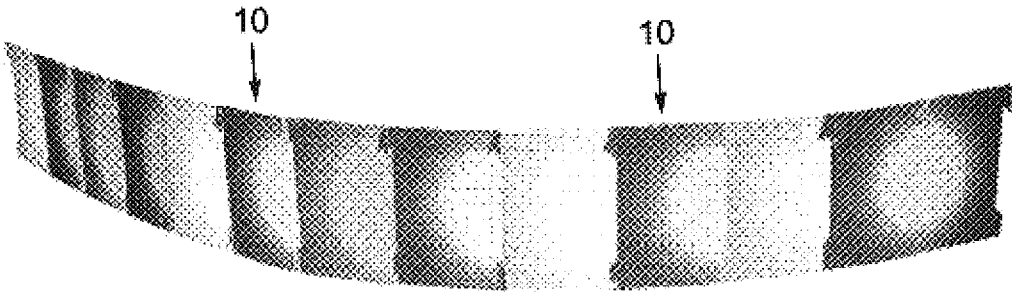
Figure 44:
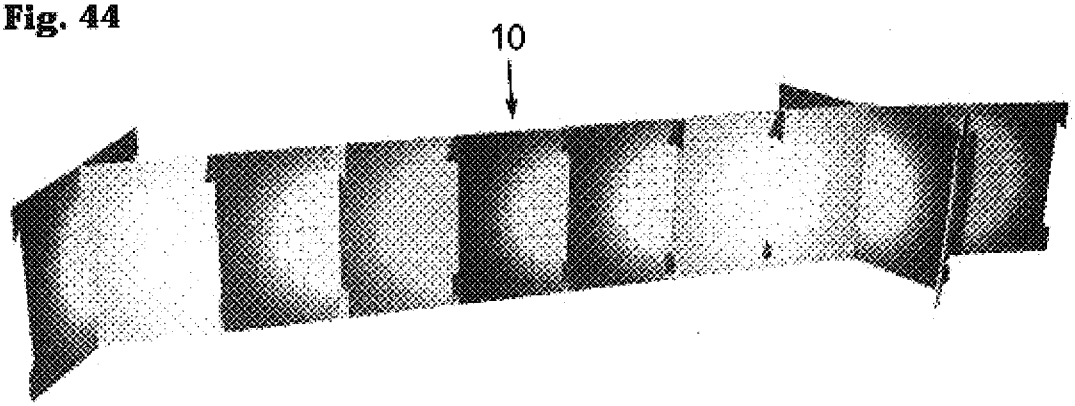
Figure 45:
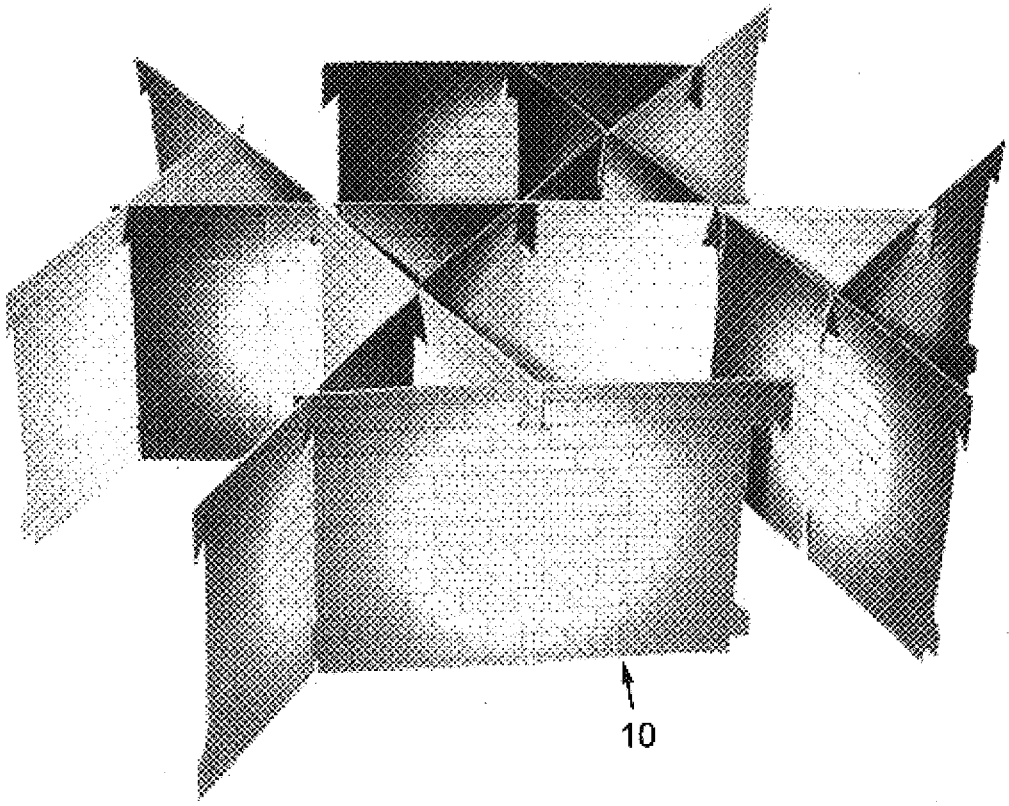
Figure 46:
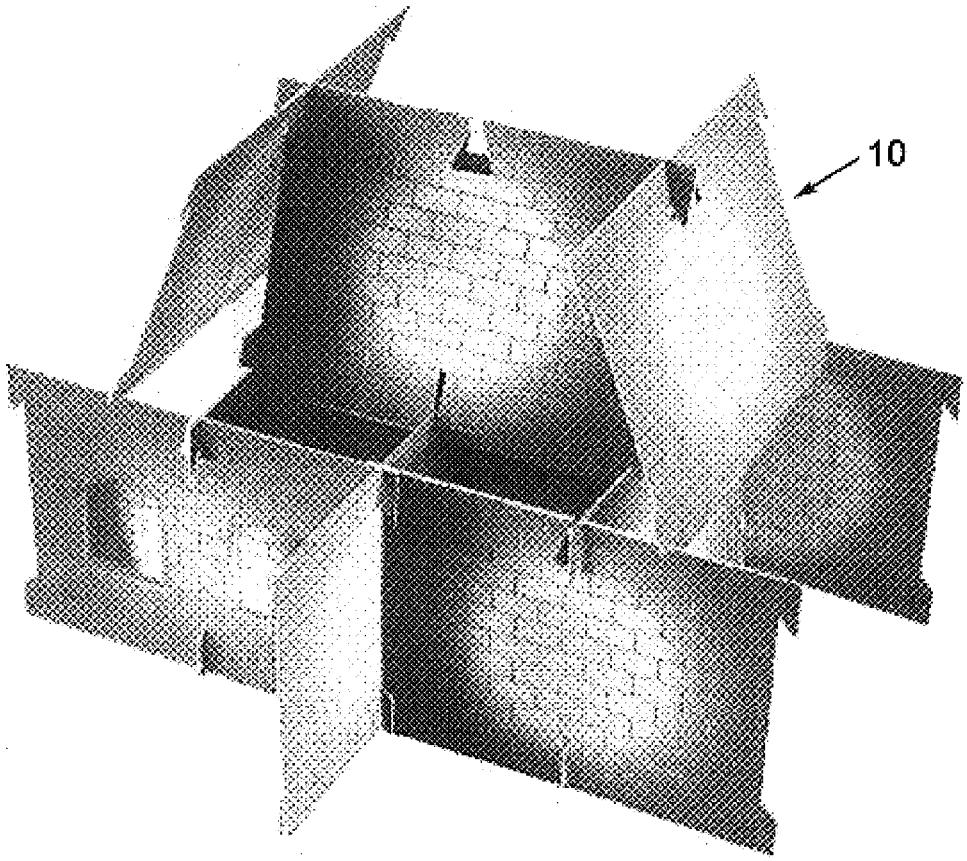
Figure 47:
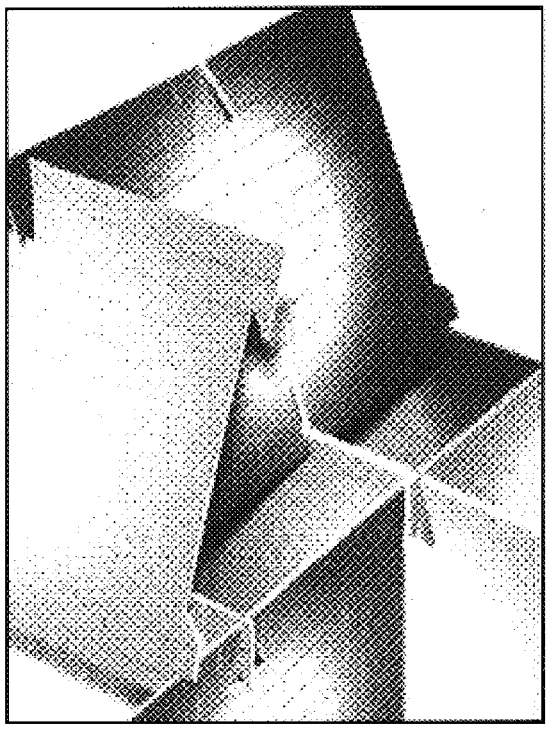

As shown in FIGS. 38 and 39, a decorative cutout character 94 is provided with a loop 96 on the face thereof. A rod like tool 98 may be used to place character 94 in a desired location.

FIGS. 40 to 47 illustrate different structures which may be formed using the construction elements of the present invention.

It will be understood that the above described embodiments are for purposes of illustration only and that changes or modifications may be made thereto without departing from the spirit and scope of the invention.

I claim:

1. A construction element for use in constructing three dimensional objects, the construction element comprising:

a generally planar main body, said main body having an upper marginal edge, a lower marginal edge, and first and second side marginal edges;

an upper recess formed in said upper marginal edge intermediate said side marginal edges;

a lower recess formed in said lower marginal edge intermediate said first and second side marginal edges;

a first upper tab formed adjacent the intersection of said upper marginal edge and first side marginal edge;

a second upper tab formed adjacent the intersection of said upper marginal edge and said second side marginal edge;

a first lower tab formed adjacent the intersection of said lower marginal edge and said first side marginal edge;

a second lower tab formed adjacent the intersection of said lower marginal edge and said second side marginal edge; and said first and second upper tabs being sized to fit within upper recesses formed in adjacent construction elements and said first and second lower tabs being sized and arranged to fit within lower recesses formed in adjacent structural construction elements, each of said upper and lower tabs extending outwardly of respective side marginal edges and each of said side marginal edge between respective upper and lower tabs having a profile which remains inwardly of said tabs.

2. The construction element of claim 1 wherein said top recess has a generally triangular configuration with a apex of said triangular configuration located along said upper marginal edge.

3. The construction element of claim 2 wherein said bottom recess comprises a narrow vertical slot.

4. The construction element of claim 3 wherein each of said first and second upper tabs extend outwardly and downwardly from their respective side marginal edge to form a notch recess between the tab and respective side wall.

5. The construction element of claim 3 wherein each of said first and second lower tabs are defined by a first diagonal edge portion extending downwardly from a respective side wall, a generally vertical edge portion parallel to a respective edge, and a bottom edge portion substantially perpendicular to a respective side wall.

6. The construction element of claim 3 wherein said construction element is formed of a material selected from cardboard, plasticized cardboard, laminated paper board, and plastic.

7. The construction element of claim 3 wherein said first and second side marginal edges are mutually parallel and substantially perpendicular to said upper and lower marginal edges.

8. The construction element of claim 3 wherein said first and second side marginal edges extend inwardly.

9. The construction element of claim 8 wherein said first and second side marginal edges extend inwardly in an arcuate concave configuration.

10. The construction element of claim 3 wherein said upper marginal edge has a plurality of recesses formed therein.

11. The construction element of claim 10 wherein said lower marginal edge has a plurality of lower recesses formed therein.

12. The construction element of claim 3 further including at least one aperture in said main body.

13. A structure comprised of a plurality of construction elements, each construction element comprising:

generally planar main body, said main body having an upper marginal edge, a lower marginal edge, and first and second side marginal edges;

an upper recess formed in the upper marginal edge intermediate said side marginal edges;

a lower recess formed in the lower marginal edge intermediate said first and second side marginal edges;

a first upper tab formed adjacent the intersection of said upper marginal edge and first side marginal edge;

a second upper tab formed adjacent the intersection of said upper marginal edge and said second side marginal edge;

a first lower tab formed adjacent the intersection of said lower marginal edge and said first side marginal edge;

a second lower tab formed adjacent the intersection of said lower marginal edge and said second side marginal edge; and said construction elements being arranged such that each of said first and second upper tabs fit within an upper recess of an adjacent construction element and each of said first and second lower tabs fit within a lower recess of an adjacent construction element, each of said upper and lower tabs extending outwardly of respective side marginal edges and each of said side marginal edge between respective upper and lower tabs having a profile which remains inwardly of said tabs.

* * * * *